US006074309A

United States Patent [19]

Mahaffey

[11] Patent Number: 6,074,309

[45] **Date of Patent: *Jun. 13, 2000**

[54] LAMINATED LIGHTWEIGHT INSERTS FOR GOLF CLUB HEADS

[75] Inventor: Steven J. Mahaffey, Hampden, Mass.

[73] Assignee: Spalidng Sports Worldwide, Inc., Chicopee, Mass.

[ * ] Notice: This patent is subject to a terminal disclaimer.

[21] Appl. No.: 09/175,937

[22] Filed: Oct. 21, 1998

Related U.S. Application Data

[63] Continuation-in-part of application No. 08/637,029, Apr. 24, 1996, Pat. No. 5,827,131.

[51] Int. Cl.[7] ..... A63B 53/04

[52] U.S. Cl. ..... 473/342; 473/345; 473/349

[58] Field of Search ..... 473/324, 329, 473/332, 342, 345, 346, 349, 350

[56] References Cited

U.S. PATENT DOCUMENTS 1,571,109 1/1926 East .
1,678,637 7/1928 Drevitson .
3,695,618 10/1972 Woolley .
5,141,231 8/1992 Cox .
5,299,807 4/1994 Hutin .
5,301,941 4/1994 Allen .
5,497,993 3/1996 Shan .
5,518,242 5/1996 Mahaffey .
5,766,094 6/1998 Mahaffey .
5,827,131 10/1998 Mahaffey .

*Primary Examiner*—Sebastiano Passaniti
*Attorney, Agent, or Firm*—Laubscher & Laubscher

[57] ABSTRACT

Golf club heads, both woods and irons, have recessed areas in the striking faces of the club heads with an insert secured therein. The insert is of a laminated structure having multiple layers and so constructed that the outer layers are of a substantially high strength to weight material and the center layers are of a relatively lower weight material. This structure allows the insert to be reduced in weight so as to allow the weight difference to be repositioned about the perimeter of the club head to achieve optimum weight distribution. One of the outer layers is preferably perforated to permit visual inspection of the center layer.

6 Claims, 2 Drawing Sheets

FIG. 1
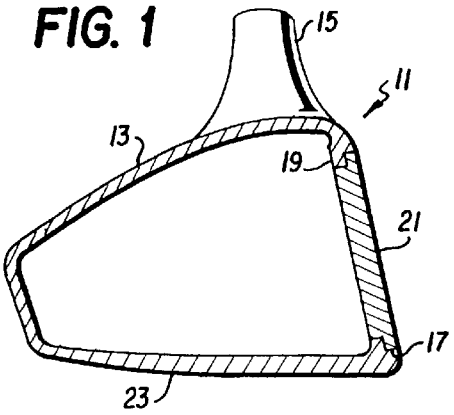
FIG. 2
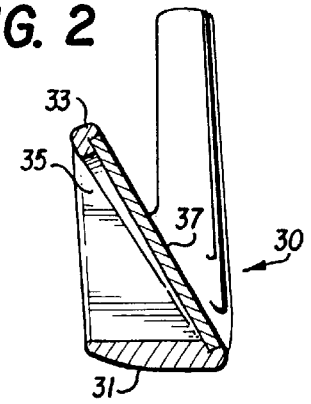
FIG. 3
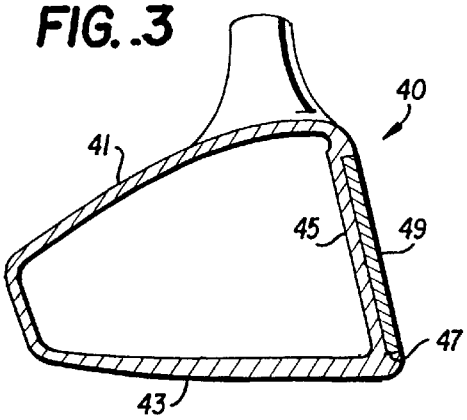
FIG. 4
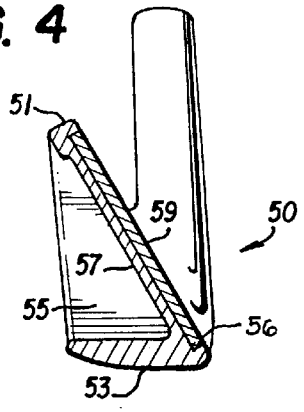
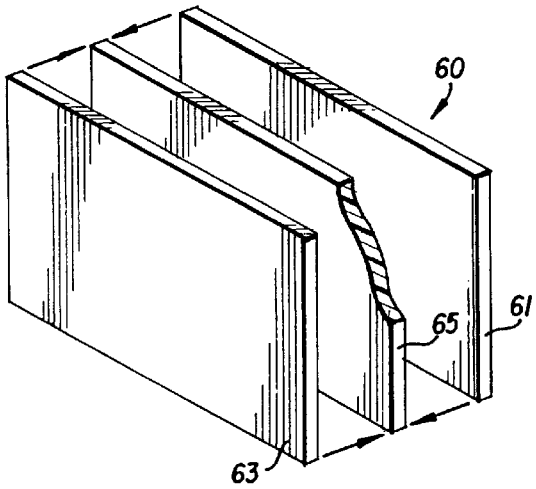
FIG. 5
FIG. 6
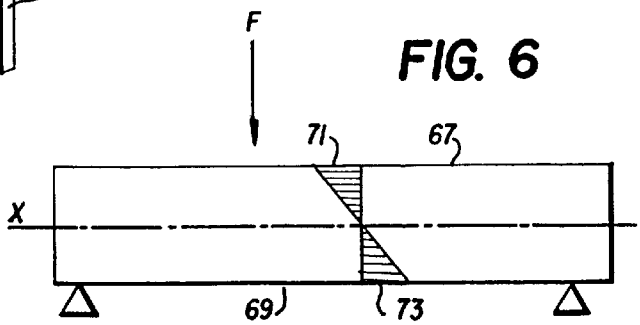

LAMINATED LIGHTWEIGHT INSERTS FOR GOLF CLUB HEADS

BACKGROUND OF THE INVENTION

This application is a continuation-in-part of U.S. application Ser. No. 08/637,029, filed Apr. 24, 1996, now U.S. Pat. No. 5,827,131.

This invention relates generally to golf club heads and more specifically to golf club heads having inserts in the striking face.

Golf clubs are designated primarily in separate categories of woods, irons, and putters. The majority of golf club woods at the present time are made of some metal or composition, while most irons are made of varying types of metal. Woods can be constructed of solid metal or can be constructed so as to have recesses in which a face or insert is placed in the striking surface. While most irons are made of metal, some also have recesses for accepting inserts for the striking face.

It is recognized that advantages are provided by redistributing the weight of golf clubs in both woods and irons so that the weight around the perimeter of the head increases to increase the moment of inertia, thereby increasing head stability, which in turn lessens head rotation that imparts side spin on the ball. This creates either a hook or slice (in the same manner as a gear effect) through impact on off-center hits.

The present invention discloses the use of various modifications of inserts so configured that part of the weight of the insert used can be redistributed to the perimeter of the head so as to increase the moment of the head.

This and other objects will become apparent from the following description taken together with the drawings.

SUMMARY OF THE INVENTION

The present invention provides golf club heads, both woods and irons, with recessed areas in the striking faces of the club heads and an insert secured within the recessed areas. The insert is of a laminated structure having multiple layers and is so constructed that the outer layers are of a substantially high strength to weight material and the center layer is of a relatively lower weight material. This structure allows the face thickness of the insert to be minimized with the major portions of the material previously required in the face to be repositioned about the perimeter of the club head to achieve optimum weight distribution. Preferably, at least one of the outer layers is perforated to provide viewing access to the center layer.

BRIEF DESCRIPTION OF THE FIGURES

FIGS. 1 and 2 are sectional views of wood-type and iron-type golf club heads, respectively, having inserts connected therewith according to a first embodiment;

FIGS. 3 and 4 are sectional views of wood-type and iron-type golf club heads, respectively, having inserts connected therewith according to a second embodiment;

FIG. 5 is an exploded view of the laminated insert according to the invention;

FIG. 6 is a diagram illustrating the tensile forces in the laminated insert of the invention.

DETAILED DESCRIPTION

Figure 7A:
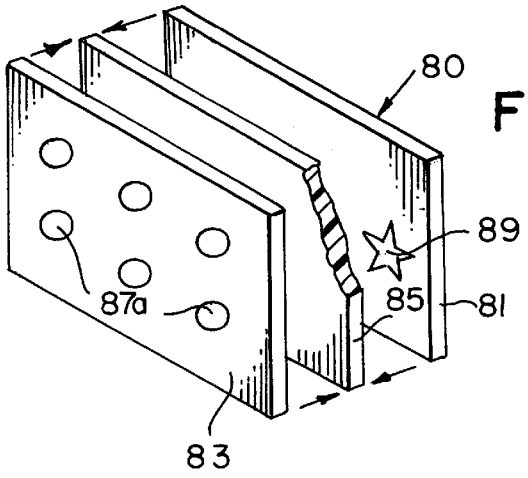
FIGS. 7*a*–7*d* are exploded views of a laminated insert illustrating various types of perforations, respectively, in the outer layers thereof according to a further embodiment of the invention.

FIG. 1 shows a metal wood 11 having a crown 13, a hosel 15, and a sole 23, with a face structure 19 having a recess 17 therein. In this particular configuration, the recess includes a lip surrounding the recess and the insert 21 is configured so as to fit within the recess and be secured therein adjacent the lip. This is commonly referred to as an unsupported insert since the club head does not have a complete surface backing adjacent the major portion of the insert.

FIG. 2 shows an iron 30 having a sole 31, a top edge 33, and a recess 35. Again this recess has a lip against which the insert 37 is placed. This also provides an iron with an unsupported face insert.

FIG. 3 shows a metal wood 40 having a crown 41, a sole 43, and a recess 47 in the face, with the recess terminating in a thin plate member 45 at the interior of the club head. Plate member 45 preferably has a thickness between 0.030 inch and 0.120 inch. Insert 49 is secured within the recess and abuts against plate 45.

FIG. 4 shows an iron 50 having a sole 53, an upper ridge 51, and a cavity 55, with a recess 56 being backed by a thin plate 57. Plate 57 is of a thickness between 0.030 and 0.120 inch. In this type of iron, insert 59 is secured within the recess and abuts against metal layer 57.

While the inserts of the present invention are of a laminate structure, such structure is not shown specifically in the FIGS. 1–4 for purposes of clarity.

FIG. 5 shows an insert 60, which is a laminate comprised of outer layers 61 and 63 and an inner layer 65. In order to reduce the weight at the center, the outer layers 61 and 63 are of a high strength material such as 6-4 titanium and are of a reduced thickness between 0.025 inch and 0.100 inch. Inner layer 65 is of a lighter weight material such as compression molded graphite.

FIG. 6 is a schematic illustration of the principle of the present invention. The insert of the present invention is similar to a beam or bridge in theory. During impact, a force F causes face 67 to flex rearwardly as it exerts force on the ball in the forward direction opposite force F. The insert acts as a beam or a bridge. For a regular insert of one material and thickness, when the face flexes rearwardly, its outer surface is in compression and also withstands the highest stress levels. These forces are shown in section 71. Rearward surface 69 is in tension equal and opposite to the face compression, with tension being illustrated in section 73 of FIG. 6.

All sections between the outer surfaces are in varying degrees of tension and compression in relation to the axis X of the moment of inertia shown in the cross section. At axis F, the stress is 0.

With the design of the present insert, since the center axis sees relatively low bending stresses, as much weight as possible is removed from that center section without degrading the structure to the point where failure will occur. In this design, the materials of a multi-laminated insert match the maximum stress for the material with its relation to the axis of the moment of inertia of the insert and the forces applied thereto. Accordingly, the optimum lightweight insert can be formed using this laminated structure. As set forth above, this permits the positioning of the removed weight of the insert about the periphery of the club head.

The following list presents examples of further materials which may be used for the inserts:

| MATERIAL | TENSILE | YIELD | DENSITY |
|---|---|---|---|
| 356 ALUMINUM | 40000 | 27000 | 0.097 |
| 7075 ALUMINUM | 83000 | 73000 | 0.101 |
| FORGING BRASS | 55000 | 20000 | 0.305 |
| BE-CU | 110000 | 90000 | 0.297 |
| 304 STAINLESS | 85000 | 35000 | 0.290 |
| 431 STAINLESS | 125000 | 95000 | 0.280 |
| 17-4 STAINLESS | 150000 | 110000 | 0.280 |
| 99.0% TITANIUM | 79000 | 63000 | 0.163 |
| 6.4 TITANIUM | 135000 | 120000 | 0.160 |

An example of the use of some of the above materials for construction of the laminate follows:

| FACE | CENTER | BACK |
|---|---|---|
| 17-4 STAINLESS | 99.0% TITANIUM | 17-4 STAINLESS |
| 6-4 TITANIUM | 7075 ALUMINUM | 6-4 TITANIUM |
| BE-CU | 356 ALUMINUM | BE-CU |
| FORGING BRASS | 356 ALUMINUM | FORGING BRASS |
| 431 STAINLESS | 7075 ALUMINUM | 17-4 STAINLESS |
| 304 STAINLESS | 356 ALUMINUM | 7075 ALUMINUM |
| 431 STAINLESS | 7075 ALUMINUM | 431 STAINLESS |

Figure 7B:
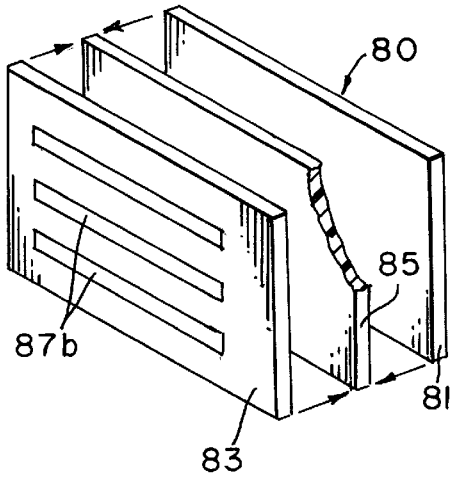
Figure 7C:
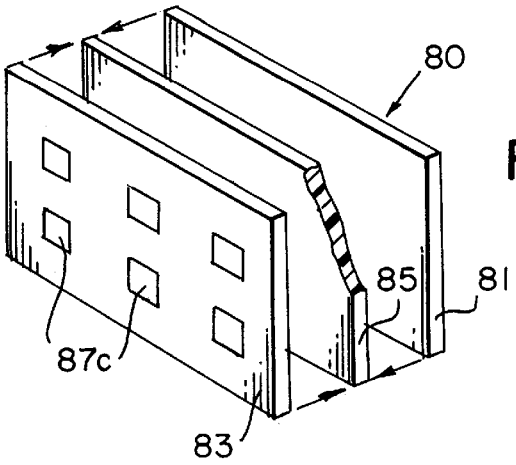
Figure 7D:
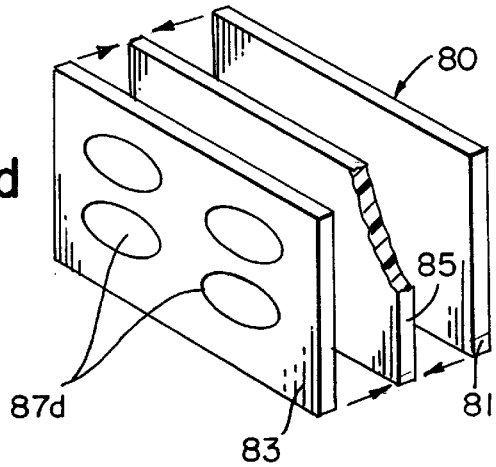

Referring now to FIGS. 7*a*–7*d*, another embodiment of the invention will be described. Shown therein is a laminated insert 80 comprising a face outer layer 81, a rear outer layer 83, and a center layer 85. This insert is for use in an iron-type club head without a backing plate such as shown in FIG. 2. The layers are formed of the same materials as set forth above in connection with the insert shown in FIG. 5. However, the rear outer layer 83 contains at least one perforation or through-opening which may have a circular configuration (87*a*, FIG. 7*a*), a rectangular configuration (87*b*, FIG. 7*b*), a square configuration (87*c*, FIG. 7*c*), an oval configuration (87*d*, FIG. 7*d*), or any other suitable geometric configuration which affords visual inspection of the center layer 5. This enables the user to confirm that the club head is in part a laminate because of the visibility of the center layer. The perforations may be hollow or may be filled with material from the center layer as a result of compression of the laminate during formation of the insert. Alternatively, the front outer layer 81 may contain one or more perforations 89. The perforations 87, 89 may have any configuration, including a distinctive logo. Perforations may be included in either outer layer, or both.

While in accordance with the provisions of the patent statute, the preferred forms and embodiment of the invention have been illustrated and described, it will be apparent to those of ordinary skill in the art, that various changes and modifications may be made without deviating from the inventive concepts set forth above.

What is claimed is:

1. A golf club head comprising (a) a striking face area containing a recess;

(b) an insert secured within said recess, an outer surface of said insert being substantially flush with a non-recessed portion of said striking face area; and (c) said insert comprising a laminate including a pair of outer layers and at least one inner layer, said outer surface being arranged on one of said insert outer layers, at least one of said outer layers containing at least one perforation providing visual inspection of said inner layer, said outer layers being formed of materials having a higher strength than that of said at least one inner layer.

2. A golf club head as defined in claim 1, wherein said outer layer contains a plurality of spaced perforations.

3. A golf club head as defined in claim 2, wherein said perforations are hollow.

4. A golf club head as defined in claim 2, wherein said perforations are at least partially filled with material from said inner layer.

5. A golf club head as defined in claim 4, wherein said outer layers of said laminate are 6-4 titanium and said inner layers are compression molded graphite.

6. A golf club head as defined in claim 4, wherein said outer layers are formed of metal and have a greater weight than said at least one inner layer.

* * * * *